US007547121B1

(12) United States Patent
Rashidi

(10) Patent No.: US 7,547,121 B1
(45) Date of Patent: Jun. 16, 2009

(54) APPARATUS TO SAFELY RETAIN A LIGHTBULB SOCKET ASSEMBLY IN A CEILING FIXTURE DURING SHIPPING AND RAPIDLY CONVERTING THE SOCKET ASSEMBLY FOR USE DURING INSTALLATION

(76) Inventor: Hamid Rashidi, 139 N. Clark Dr., Beverly Hills, CA (US) 90211

( * ) Notice: Subject to any disclaimer, the term of this patent is extended or adjusted under 35 U.S.C. 154(b) by 157 days.

(21) Appl. No.: 11/656,281

(22) Filed: Jan. 22, 2007

(51) Int. Cl.
*F21S 8/02* (2006.01)
*F21V 21/02* (2006.01)

(52) U.S. Cl. ..... 362/365; 362/147; 362/448

(58) Field of Classification Search ..... 362/433–454, 362/147–150, 364–366, 374–378
See application file for complete search history.

(56) References Cited

U.S. PATENT DOCUMENTS 5,034,869 A * 7/1991 Choi ..... 362/363
5,222,800 A * 6/1993 Chan et al. ..... 362/147
5,440,471 A * 8/1995 Zadeh ..... 362/365
5,548,499 A * 8/1996 Zadeh ..... 362/366
6,174,077 B1 * 1/2001 Bucher et al. ..... 362/438
6,364,511 B1 * 4/2002 Cohen ..... 362/368
6,536,926 B2 * 3/2003 Bucher et al. ..... 362/438

* cited by examiner

*Primary Examiner*—Bao Q Truong
(74) *Attorney, Agent, or Firm*—Thomas I. Rozsa

(57) ABSTRACT

The present invention is an improvement to a ceiling fixture which includes a retaining clip affixed to the base plate of the ceiling fixture, the retaining clip having a pair of vertically spaced apart parallel arms with receiving members therein. The socket has a spring clip affixed thereto with spring arms having retaining members thereon. The retaining members can be inserted into the receiving members of the retaining clip with the socket face down so that the interior of the socket faces the base plate and is retained in this secure manner during shipping. When the fixture is ready to be installed, the arms of the spring clip on the socket are pressed together to remove the spring arm retaining members from the retaining clip, the socket is turned one hundred and eighty degrees so that the lightbulb receiving opening extends away from the base plate and the retaining members from the spring clip are once again inserted into the retaining means on the retaining clip and held therein for the in use condition to receive a lightbulb in the socket.

13 Claims, 5 Drawing Sheets

| 4A | 4B |
|---|---|

APPARATUS TO SAFELY RETAIN A LIGHTBULB SOCKET ASSEMBLY IN A CEILING FIXTURE DURING SHIPPING AND RAPIDLY CONVERTING THE SOCKET ASSEMBLY FOR USE DURING INSTALLATION

BACKGROUND OF THE INVENTION

1. Field of the Invention

The present invention relates to the field of lighting fixtures and more particularly to socket assemblies which are retained within a recessed ceiling fixture.

2. Description of the Prior Art

In general, ceiling fixtures come with pre-attached and pre-wired lightbulb sockets. However, during shipment, it is easy for the sockets to be damaged. Therefore, there is a significant need for an improved method and apparatus to protect the socket assembly during the shipping process while it is attached to the ceiling fixture and to also facilitate rapid installation of the socket assembly when the fixture is being installed.

SUMMARY OF THE INVENTION

The present invention is an improvement to a ceiling fixture which includes a retaining clip affixed to the base plate of the ceiling fixture, the retaining clip having a pair of vertically spaced apart parallel arms with receiving members therein. The socket has a spring clip affixed thereto with spring arms having retaining members thereon. The retaining members can be inserted into the receiving members of the retaining clip with the socket face down so that the interior of the socket faces the base plate and is retained in this secure manner during shipping. When the fixture is ready to be installed, the arms of the spring clip on the socket are pressed together to remove the spring arm retaining members from the retaining clip, the socket is turned one hundred and eighty degrees so that the lightbulb receiving opening extends away from the base plate and the retaining members from the spring clip are once again inserted into the retaining means on the retaining clip and held therein for the in use condition to receive a lightbulb in the socket.

It has been discovered, according to the present invention that if the base plate of a ceiling fixture is equipped with a retaining clip having vertically extending arms which have receiving means therein and the socket assembly is equipped with a spring clip having spring retaining arms thereon, then the socket can be held by the spring clip into the receiving means of the retaining clip in two alternative ways; the first way is for the socket lightbulb opening to be facing the base plate so that the socket is protected during shipping, and the second way is to have the socket retained so that the lightbulb receiving opening is exposed in the in use condition, so that the socket can be protected during shipping and quickly converted to the in use condition when the ceiling fixture is installed.

It is therefore an object of the present invention to provide an apparatus which securely retains the socket assembly in the ceiling fixture so that the socket opening which receives the lightbulb is protected during shipping and permits a rapid conversion so that the socket can be quickly converted to the in use condition in the ceiling fixture and retained by the same retaining mechanism by which the socket was retained during shipping.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 2:
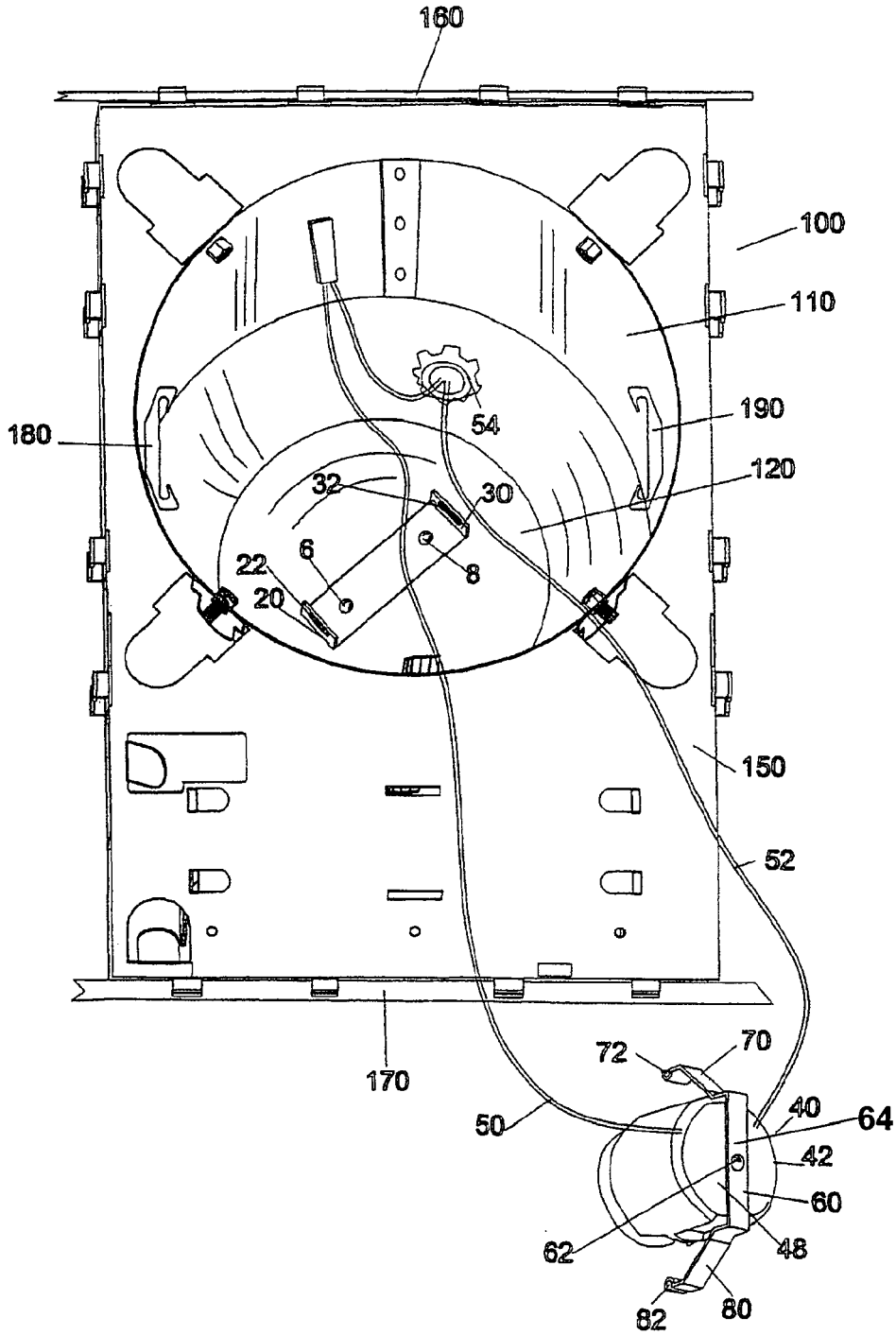
FIG. 2 is a top perspective view of a housing for a recessed lighting ceiling fixture showing the present invention retaining clip affixed to the base plate of the ceiling fixture and the socket assembly removed therefrom.
Figure 4A:
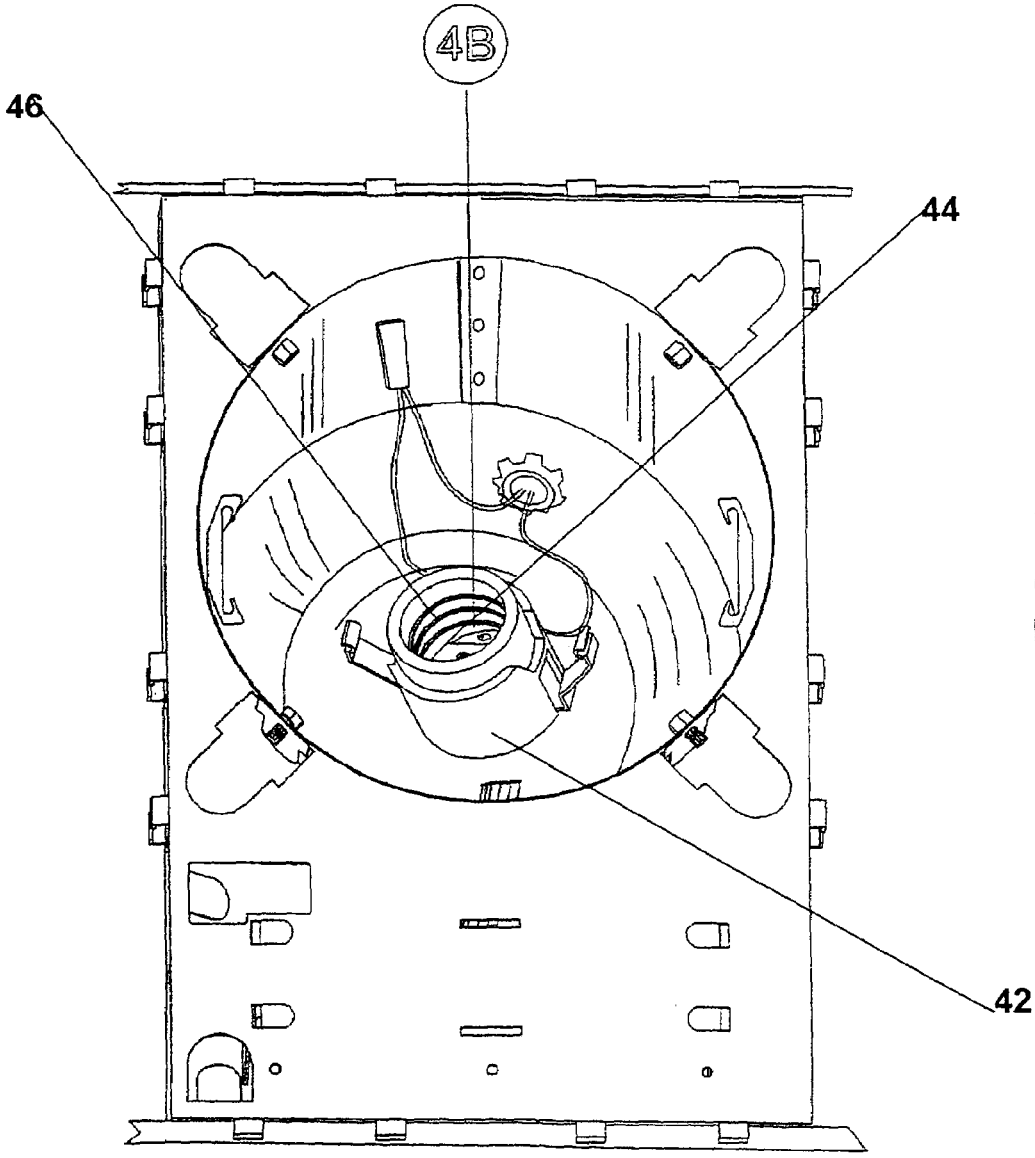
FIG. 4A is a top perspective view of a housing for a recessed lighting ceiling fixture showing the present invention retaining clip affixed to the base plate of the ceiling fixture and the socket assembly attached to the retaining clip after installation and in the is use condition.
Figures 4, 4B:
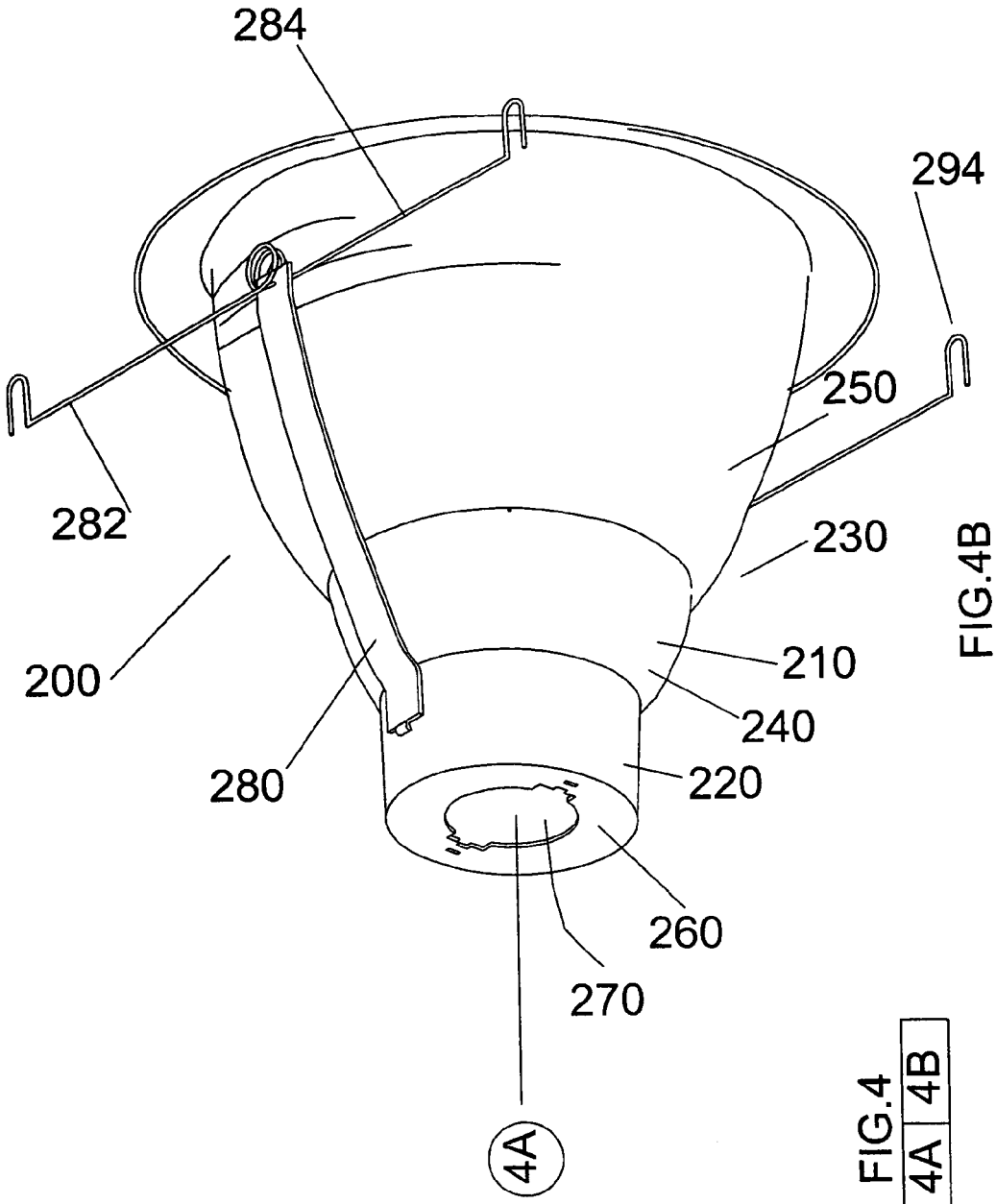
FIG. 4B is a perspective view of a reflector which will be retained in the ceiling fixture.

Referring to FIG. 2, there is illustrated a top plan view of a conventional housing 100 for a recessed lighting ceiling fixture. The housing contains a metal housing member 110 which has a horizontal base plate 120. The housing member 110 is affixed to a metal plate 150 which in turn is connected to bar hangers 160 and 170 by which the ceiling fixture is mounted between beams in the ceiling where the recessed lighting fixture is to be mounted. The interior wall of the housing 110 also contains a pair of oppositely disposed retaining clip members 180 and 190 by which a reflector 200 is mounted in the housing 110. Referring to FIG. 4B, a reflector 200 has a body 210 including at least a lower section 220 and a upper section 230 upper sections has two parts 240 and 250 in the reflector illustrated. The lower section 220 has a transverse bottom wall 260 with an opening into which a socket assembly extends so that a lightbulb can be inserted into a socket of the socket assembly. On each side of the reflector is a spring clip with rotatable hook retaining means affixed thereto. Spring clip 280 supports rotatable hook retaining means 282 and 284. A comparable assembly is on the opposite side of the reflector, of which only rotatable hook retaining means 294 is visible. After the socket assembly is installed as will be described, the reflector 200 is retained in the ceiling housing fixture 110 by rotatable hook retaining means retained by clip 180 and the opposite hook retaining means retained by retaining clip 190 so that opening 270 fits over the socket assembly.

Figure 1:
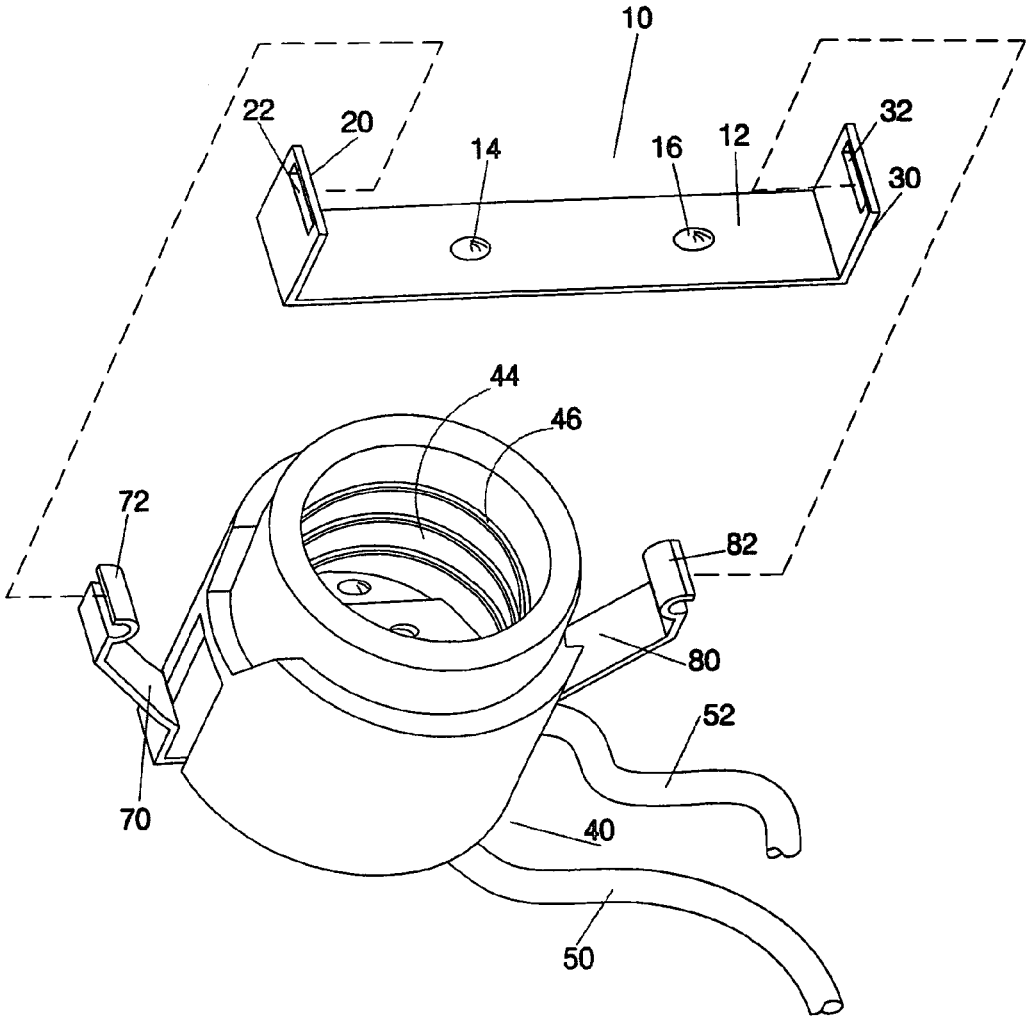
FIG. 1 is a is an exploded view of the components of the present invention socket protection and retaining apparatus including a retaining clip with spaced apart arms having female retaining members and a male spring clip assembly attached to the socket assembly for retention by the retaining clip.

The present invention improvement will now be described. Referring to FIGS. 1 and 2, the first component of the improvement is the addition of a retaining clip 10 which has a horizontal section 12 having openings 14 and 16, and which horizontal section extends into oppositely disposed parallel vertical walls 20 and 30. Vertical wall 20 has a transverse opening 22 and vertical wall 30 has a transverse opening 32. Preferably opening 22 and 32 are parallel and are aligned at the same distance from the horizontal section 12. Horizontal section 12 is affixed to the base plate 120 by at least one mounting means such as a mounting screw. Preferably two spaced apart mounting screws 6 and 8 are used for stability and are respectively inserted through openings 14 and 16 in the horizontal section and screwed into the base plate. The mounting means can also be rivets or any other suitable mounting means by which the horizontal section 12 is affixed to the center of the base plate 120 as illustrated in FIG. 2. The vertical walls 20 and 30 extend upwardly from the base plate with their respective openings 22 and 32 situated above the base plate 120.

The second portion of the present invention improvement is the addition of a male spring clip affixed to the socket assembly. Referring to FIGS. 1, 2 and 4A, the socket assembly 40 has an exterior wall 42 and an internal chamber 44 with mating threads 46 to receive the threads of an incandescent lightbulb. The socket assembly 40 can also be configured to retain a fluorescent lightbulb or any other type of lightbulb. Electrical wires 50 and 52 are connected to a connecting nut 54 which connects the wires 50 and 52 to wiring from a junction box wired into the electricity of the structure into which the ceiling fixture is affixed. A male spring clip 60 is affixed to the bottom wall 48 of the socket assembly 40 by attaching means such as a rivet 62. The spring clip 60 has a bottom section 64 by which it is attached to bottom wall 48 of the socket assembly and two flexible arms 70 and 80 each terminating in a transverse protruding section 72 and 82.

Figure 3:
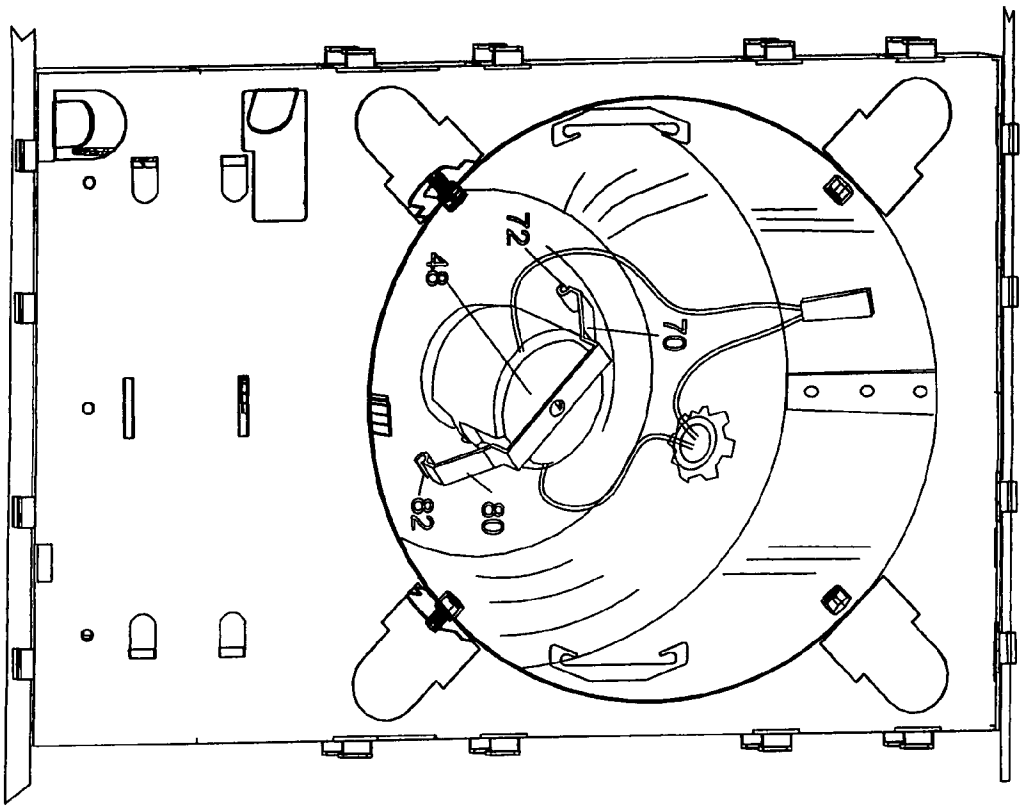
FIG. 3 is a top perspective view of a housing for a recessed lighting ceiling fixture showing the present invention retaining clip affixed to the base plate of the ceiling fixture and the socket assembly attached to the retaining clip during shipping of the ceiling fixture to protect the socket assembly.

Referring to FIG. 3, during shipment of the ceiling fixture 110 before installation, the socket assembly is turned upside down so that the internal chamber 44 faces the base plate 120 and the socket assembly 40 is firmly held in retaining clip 10 by spring clip 60 held by the retaining clip 10, with protruding section 72 of flexible arm 70 inserted into opening 22 of vertical section 20 of spring clip 10 and protruding section 82 of flexible arm 80 inserted into opening 32 of vertical section 30 of spring clip 10. As a result, the socket assembly 40 is securely held by the retaining clip 10 in a manner by which the interior chamber 44 and delicate threads 46 or other lightbulb connecting means face the base plate and are protected from damage during shipping.

When the ceiling fixture is installed, the flexible arms 70 and 80 of the spring clip 60 are pressed together to remove the protruding sections 72 and 82 from the retaining clip openings 22 and 32 in the retaining and turned upside down so that the bottom wall 48 of the socket assembly 40 is pressed against the horizontal section 12 of the retaining clip 10 and the spring clip once again is pressed inwardly so that the protruding sections 72 and 82 of flexible arms 70 and 80 are once again inserted into openings 22 and 32 in vertical arms 20 and 30 of retaining clip 10 and retained therein so that the socket opening 44 and threads face outwardly to receive a lightbulb. Therefore, through the present invention, the socket assembly is retained in a secure manner during shipping and can be very quickly converted to its in use condition when the ceiling fixture 110 is installed.

The reflector 200 is then installed into the housing 110 in the manner previous described and the installation of the ceiling fixture is complete.

While the arms 20 and 30 of the retaining clip 10 have been described with female retaining members and the retaining clip 60 has been described as having arms with male retaining members, it will be appreciated that it is within the spirit and scope of the present invention for the retaining means to be reversed so that the retaining clip 10 has male retaining members and spring clip 60 has female receiving members on its arms 70 and 80 to receive the male retaining members from the retaining clip 10.

Defined in detail, the present invention is a ceiling fixture having a base plate, the improvement comprising: (a) a retaining clip having a horizontal section and a pair of parallel oppositely disposed arms respectively positioned at each end of the horizontal section and extending generally perpendicular to the horizontal section, each arm having a receiving means therein, the horizontal section affixed to the base plate; (b) a socket assembly having an interior chamber which has a lightbulb receiving means and an exterior surface, a spring clip retaining means affixed to the exterior surface of the socket assembly, the spring clip having a pair of oppositely disposed flexible arms each arm having a mating means thereon; and (c) a respective mating means on a flexible arm of the spring clip inserted into a receiving means on the arms of the retaining clip to retain the socket assembly adjacent to the base plate, the socket capable of being retained so that its interior chamber faces toward the base plate so that it is protected and the socket also capable of being retained so that the interior chamber faces away from the base plate when in an in use condition.

Defined more broadly, the present invention is a ceiling fixture having a base plate, the improvement comprising: (a) a retaining clip having a horizontal section and a pair of parallel oppositely disposed arms respectively positioned at each end of the horizontal section and extending away from the horizontal section, each arm having a receiving means therein, the horizontal section affixed to the base plate; (b) a socket assembly having an interior chamber which has a lightbulb receiving means and an exterior surface, a spring clip retaining means affixed to the exterior surface of the socket assembly, the spring clip having a pair of oppositely disposed flexible arms each arm having a mating means thereon; and (c) a respective mating means on a flexible arm of the spring clip inserted into a receiving means on the arms of the retaining clip to retain the socket assembly adjacent to the base plate, the socket capable of being retained so that its interior chamber faces toward the base plate so that it is protected and the socket also capable of being retained so that the interior chamber faces away from the base plate when in an in use condition.

Defined most broadly, the present invention is a ceiling fixture having a base plate, the improvement comprising: (a) a retaining clip affixed to the base plate and having a pair of retaining arms each having a receiving means therein; (b) a socket assembly having an interior chamber which has a lightbulb receiving means and an exterior surface, a spring clip retaining means affixed to the socket assembly, the spring clip having a pair of oppositely disposed flexible mating means thereon; and (c) a respective mating means of the spring clip inserted into a receiving means of the retaining clip to retain the socket assembly adjacent to the base plate, the socket capable of being retained so that its interior chamber faces toward the base plate so that it is protected and the socket also capable of being retained so that the interior chamber faces away from the base plate when in an in use condition.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A ceiling fixture having a base plate, the improvement comprising:

a. a retaining clip having a horizontal section and a pair of parallel oppositely disposed arms respectively positioned at each end of the horizontal section and extending generally perpendicular to the horizontal section, each arm having a receiving means therein, the horizontal section affixed to the base plate;

b. a socket assembly having an interior chamber which has a lightbulb receiving means and an exterior surface, a spring clip retaining means affixed to the exterior surface of the socket assembly, the spring clip having a pair of oppositely disposed flexible arms each arm having a mating means thereon; and c. in a first condition, a respective mating means on a flexible arm of the spring clip inserted into a receiving means on the arms of the retaining clip to retain the socket assembly adjacent to the base plate so that the socket is retained with its interior chamber facing toward the base plate so that the interior chamber of the socket is protected during shipment and in a second condition, a respective mating means on a flexible arm of the spring clip is inserted into a receiving means on the arms of the retaining clip so that the socket is retained so that the interior chamber faces away from the base plate when used to retain a light bulb.

2. The ceiling fixture in accordance with claim 1 wherein the receiving members on the arms of the retaining clip are female receiving members and the mating means on the arms of the spring clip are male mating members.

3. The ceiling fixture in accordance with claim 2 wherein the female receiving means are parallel aligned openings with a respective opening in each arm of the retaining clip.

4. The ceiling fixture in accordance with claim 2 wherein each male mating member is a protrusions which extends from each flexible arm.

5. The ceiling fixture in accordance with claim 1 wherein the receiving members on the arms of the retaining clip are male receiving members and the mating means on the arms of the spring clip are female mating members.

6. A ceiling fixture having a base plate, the improvement comprising:

a. a retaining clip having a horizontal section and a pair of parallel oppositely disposed arms respectively positioned at each end of the horizontal sectional and extending away from the horizontal section, each arm having a receiving means therein, the horizontal section affixed to the base plate;

b. a socket assembly having an interior chamber which has a lightbulb receiving means and an exterior surface, a spring clip retaining means affixed to the exterior surface of the socket assembly, the spring clip having a pair of oppositely disposed flexible arms each arm having a mating means thereon; and c. in a first condition, a respective mating means on a flexible arm of the spring clip inserted into a receiving means on the arms of the retaining clip to retain the socket assembly adjacent to the base plate so that the socket is retained with its interior chamber facing toward the base plate so that the interior chamber of the socket is protected during shipment and in a second condition, a respective mating means on a flexible arm of the spring clip is inserted into a receiving means on the arms of the retaining clip so that the socket is retained so that the interior chamber faces away from the base plate when used to retain a light bulb.

7. The ceiling fixture in accordance with claim 6 wherein the receiving members on the arms of the retaining clip are female receiving members and the mating means on the arms of the spring clip are male mating members.

8. The ceiling fixture in accordance with claim 7 wherein the female receiving means are parallel aligned openings with a respective opening in each arm of the retaining clip.

9. The ceiling fixture in accordance with claim 7 wherein each male mating member is a protrusions which extends from each flexible arm.

10. The ceiling fixture in accordance with claim 6 wherein the receiving members on the arms of the retaining clip are male receiving members and the mating means on the arms of the spring clip are female mating members.

11. A ceiling fixture having a base plate, the improvement comprising:

a. a retaining clip affixed to the base plate and having a pair of retaining arms each having a receiving means therein;

b. a socket assembly having an interior chamber which has a lightbulb receiving means and an exterior surface, a spring clip retaining means affixed to the socket assembly, the spring clip having a pair of oppositely disposed flexible mating means thereon; and c. in a first condition, a respective mating means of the spring clip inserted into a receiving means of the retaining clip to retain the socket assembly adjacent to the base plate, the socket is retained with its interior chamber facing toward the base plate so that the interior chamber of the socket is protected during shipment and in a second condition, a respective mating means on a flexible arm of the spring clip is inserted into a receiving means on the arms of the retaining clip so that the socket is retained so that the interior chamber faces away from the base plate when used to retain a light bulb.

12. The ceiling fixture in accordance with claim 11 wherein the receiving members of the retaining clip are female receiving members and the mating means on the spring clip are male mating members.

13. The ceiling fixture in accordance with claim 11 wherein the receiving members of the retaining clip are male receiving members and the mating means on the spring clip are female mating members.

* * * * *